United States Patent [19]

Furuyama

[11] Patent Number: 4,873,950

[45] Date of Patent: Oct. 17, 1989

[54] ENGINE START CONTROL APPARATUS

[75] Inventor: Masaaki Furuyama, Hoya, Japan

[73] Assignee: Fuji Jukogyo Kabushiki Kaisha, Tokyo, Japan

[21] Appl. No.: 234,685

[22] Filed: Aug. 22, 1988

[30] Foreign Application Priority Data

Aug. 28, 1987 [JP] Japan ..... 62-216128

[51] Int. Cl.[4] ..... F02D 45/00; F02D 41/06

[52] U.S. Cl. ..... 123/179 B; 123/179 BG; 123/491; 364/431.1

[58] Field of Search ..... 123/179 B, 179 BG, 179 G, 123/179 L, 362, 424, 491; 364/431.1

[56] References Cited

U.S. PATENT DOCUMENTS 4,397,281 8/1983 Nakano et al. ..... 123/179 B
4,491,922 1/1985 Kobayashi et al. ..... 123/491
4,543,937 10/1985 Amano et al. ..... 123/491
4,550,373 10/1985 Ito et al. ..... 123/179 G
4,557,234 12/1985 Ito ..... 123/179 G
4,712,522 12/1987 Anzai et al. ..... 123/491

*Primary Examiner*—Andrew M. Dolinar
*Attorney, Agent, or Firm*—Beveridge, DeGrandi & Weilacher

[57] ABSTRACT

An engine start control apparatus of the type that the running of the engine is controlled by a controller in accordance with data obtained from at least one sensor mounted on the engine and stored in a backup memory. The engine start control apparatus includes a starting condition detector unit for detecting a start ready state of the engine and outputting a start ready signal, a signal processing unit for processing an output signal from the sensor and storing the processed result into the backup memory in response to the start ready signal from the starting condition detector unit, a start detection unit for detecting the start of the engine and a power supply unit for supplying a power voltage to the controller in response to an output from the start detection means.

6 Claims, 3 Drawing Sheets

ENGINE START CONTROL APPARATUS

BACKGROUND OF THE INVENTION

1. Field of the Art

The present invention relates to an engine start control apparatus capable of avoiding malfunction of an engine controller due to a voltage drop at the start-up of the engine.

2. Prior Art

A conventional engine is mounted with an electronically controlled fuel injection device. This engine controller first calculates a basic fuel injection quantity based on an air suction amount and an engine revolution number, and next calculates an actual fuel injection quantity by correcting the basic fuel injection quantity in accordance with a correction coefficient obtained based on the engine temperature and the like and by feedback correcting the basic fuel injection quantity in accordance with an air-fuel ratio decided based on the oxygen concentration of an exhaust gas. The controller is powered with a battery.

It is known that the output voltage of a battery lowers as the ambient temperature falls. The output voltage lowers considerably if an engine is started at a low temperature. Thus, the controller often operates abnormally. To avoid this, a plurality of batteries may be provided. However, this results in a complicated structure of the controller and an additional space for mounting the batteries.

SUMMARY OF THE INVENTION

It is therefore an object of the present invention to provide an engine start control apparatus with simple structure, easy in handling, unnecessary for additional space in the engine room, and good at the start performance without being influenced by the voltage drop of a battery.

To achieve the above object of the present invention, in an engine start control apparatus of the type that the running of the engine is controlled by a controller in accordance with data obtained from sensors attached to the engine and stored in a backup memory, the engine start control apparatus is characterized by comprising: starting condition detector means for detecting a start ready state of said engine and outputting a start ready signal; signal processing means for storing an output signal from said sensors into said backup memory in response to said start ready signal; start detection means for detecting the start of said engine; and power supply means for supplying a power voltage to said controller in response to an output from said start detection means.

DETAILED DESCRIPTION OF THE PREFERRED EMBODIMENT

First, the problems associated with conventional engine start control apparatus will be described with reference to FIGS. 3 to 5.

For the above-mentioned engine control parameters, an air suction amount sensor such as an air flow meter is used in measuring the air suction amount, a crank angle sensor or the like is used in measuring the engine revolution number, a water temperature sensor or the like is used in measuring the engine temperature, and an oxygen sensor or the like is used in measuring the air-fuel ratio feedback control value.

Figure 5:
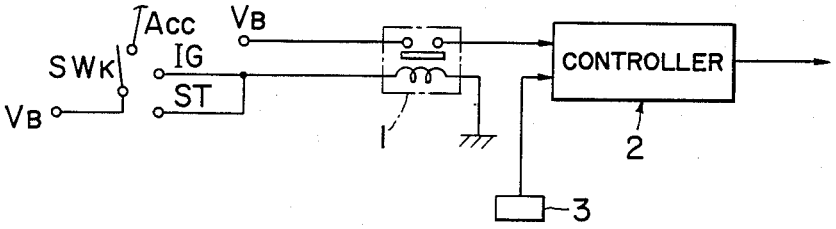
FIG. 5 PRIOR ART
FIG. 5 is a schematic diagram showing a conventional start control apparatus.

As shown in FIG. 5, in a start cranking operation, a key switch SWk is caused to connect a battery $V_B$ to an ignition contact IG so that a relay switch 1 is turned on to connect the battery $V_B$ to a controller 2. Next, the key switch SWk is caused to connect a starter contact ST to effect the start cranking operation. In this case, the controller 2 controls the fuel injection quantity, ignition timings, opening of an idle speed control valve (ISCV) and the like in accordance with information such as the engine temperature obtained from a water temperature sensor 3.

Figure 3:
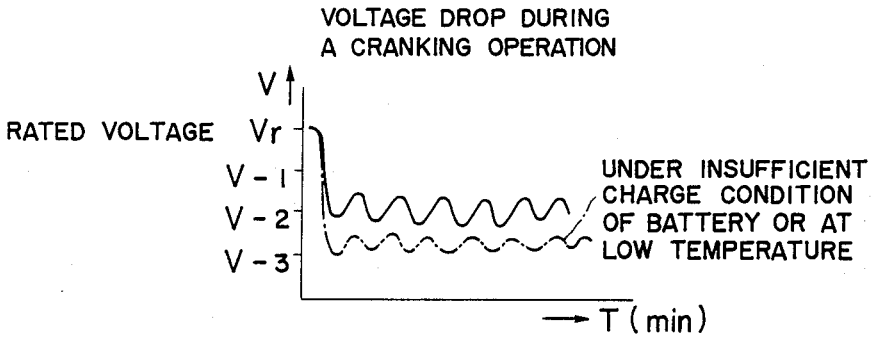
FIG. 3 is a graph showing the voltage drop characteristics of a battery during cranking.

The voltage drop of the battery $V_B$ during the cranking operation is shown in FIG. 3. As seen from FIG. 3, since a large current flows to a starter motor during the cranking operation, the voltage V of the battery $V_B$ considerably lowers from a rated voltage Vr down to V-3. The voltage drop is likely to be affected by a charge condition of the battery and an ambient temperature. The voltage drop is very large, especially under an insufficient charge condition or at a low temperature.

During the cranking operation, the voltage V undergoes a very large drop so that the voltage applied to the controller 2 also lowers considerably.

Figure 4:
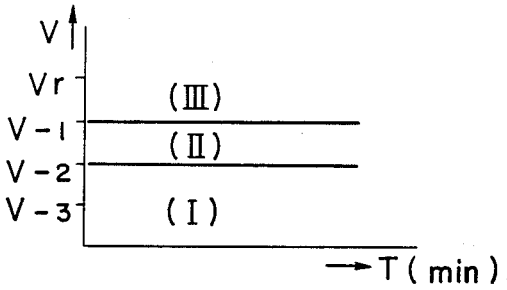
FIG. 4 PRIOR ART
FIG. 4 is a graph showing the allowable operation areas of a controller at various conditions of a battery according to a prior art.

FIG. 4 shows the allowable operation areas of the controller 2 at various conditions. Under a sufficient charge of the battery and an ordinary temperature, the voltage V is maintained within an area (III) so that the controller operates normally although a slight voltage drop is present at the controller 2. However, under an insufficient charge or a low temperature, the voltage V lowers down into an area (II) so that an output signal from the water temperature sensor 3 will be converted into a digital signal with some error, thus leading to degraded reliability of the controller.

If the voltage V of the battery falls down into an area (I) at a very cold location or the like, the output signal from the water temperature sensor 3 will fluctuate, and the A/D converter, an operation unit of a central processing unit (CPU), and the like of the controller 2 will not operate. Accordingly, data from various sensors cannot be picked up so that the fuel injection quantity, ignition timings, opening of the ISCV cannot be controlled, thus leading to inability of the proper start of the engine.

A technique for compensating for the voltage drop due to a low temperature is disclosed, e.g., in Japanese Laid-open Utility Model Publication No. 57-40660 wherein a plurality of batteries are provided and they are connected in series for starting an engine at a low temperature.

This technique, however, is not practical since the space for other components in the engine room is limited by the space for the additional batteries which are used only in starting the engine at a low temperature. In addition, the work efficiency within the engine room is deteriorated by the provision of a plurality of batteries.

Another technique is also disclosed, e.g., in Japanese Patent Laid-Open Publication No. 57-13238 wherein the voltage of a battery is being monitored by a controller, and when the voltage drops to such a value that the controller will no more operate normally, backup control information previously set is used for controlling such as the fuel injection quantity.

With this technique, however, it is necessary to additionally provide a battery voltage monitoring circuit, backup control information, and associated control circuits, thus resulting in complicated structure. In addition, although the start control must be performed using an optimum combination of the air-fuel ratio, ignition timings, air suction amount and the like in accordance with the temperature at that time, this technique uses the fixed backup control information previously set. Therefore, the start operation is not always conducted at an optimum condition, and it is difficult to always obtain a good start operation.

DESCRIPTION OF THE PREFERRED EMBODIMENT

Figure 1:
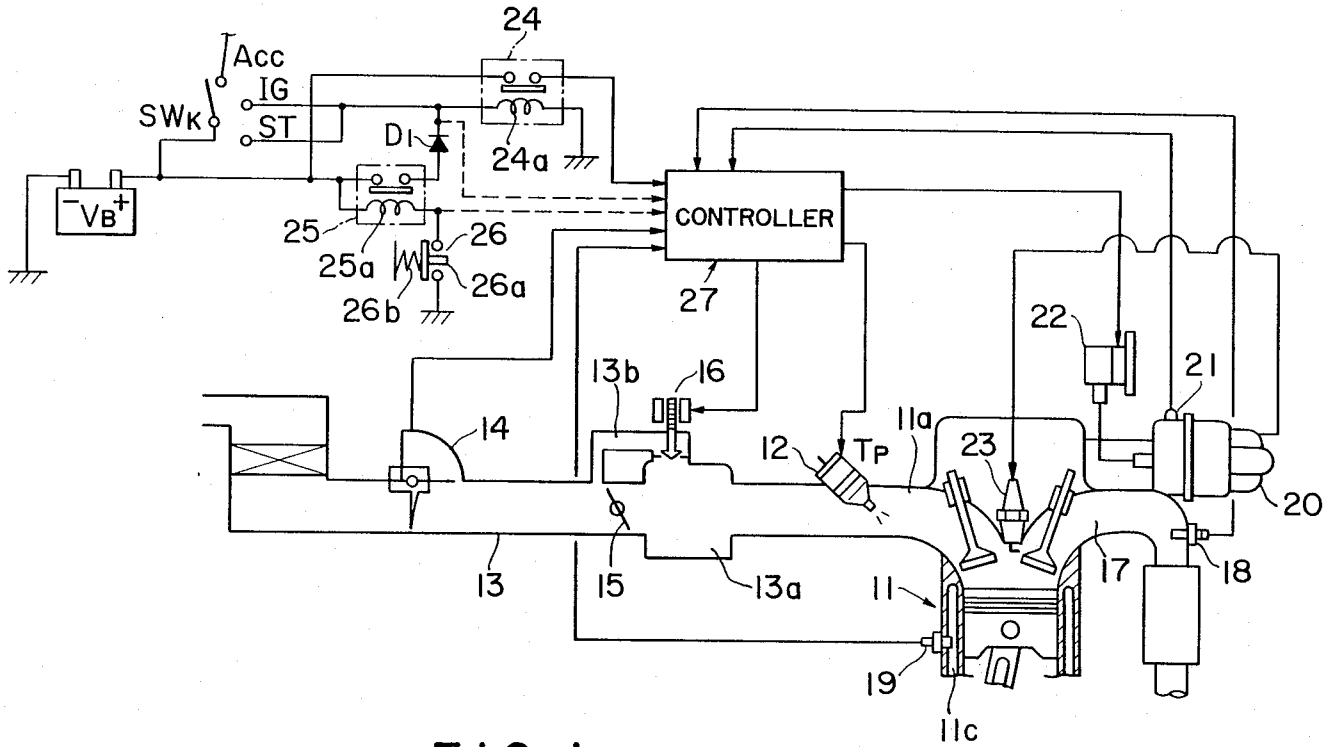
FIG. 1 is a schematic diagram showing the main part of an embodiment of an engine start control system according to the present invention.
Figure 2:
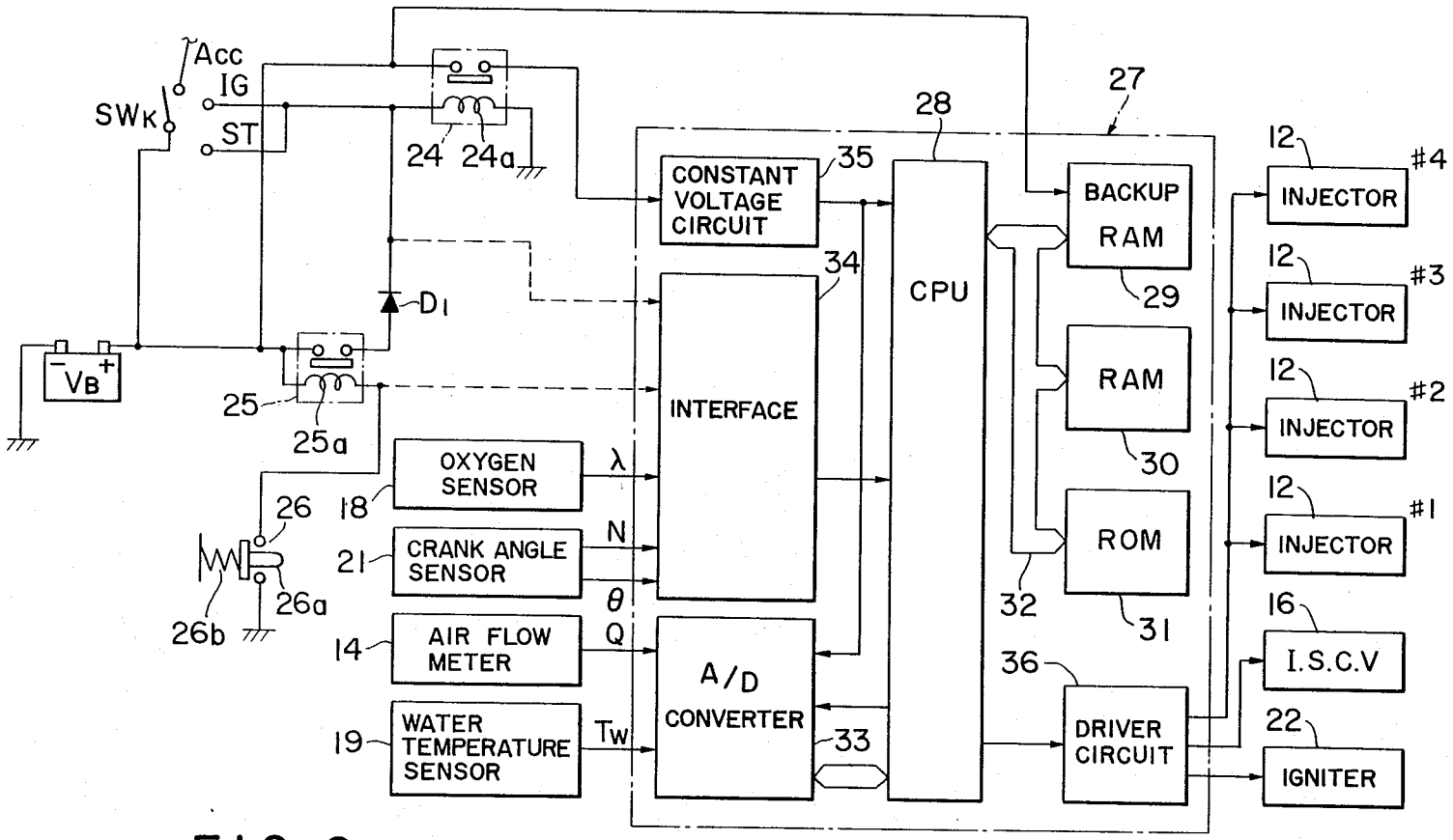
FIG. 2 is a block diagram of the engine start control apparatus shown in FIG. 1.

FIG. 1 is a schematic diagram showing the main part of an embodiment of an engine control system according to the present invention, and FIG. 2 is a block diagram of the start control apparatus shown in FIG. 1.

An engine is generally represented by reference numeral 11 in FIG. 1. An injector 12 is mounted near an air suction port 11*a* of the engine 11. An air flow meter 14, for example, used as an air suction amount sensor is mounted at the upstream of an air suction passage 13 communicating with the air suction port 11*a*.

An idle speed control valve (ISCV) 16 for controlling an air suction flow during an idling operation is mounted at an air passage 13*b* which bypasses the air suction passage 13 between at the upstream of a throttle valve 15 mounted within the passage 13 and an air chamber 13*a* at the downstream of the throttle valve 15.

An oxygen sensor 18 for detecting an air-fuel feedback value is mounted near an exhaust gas passage 17 of the engine 11. A water temperature sensor 19 for detecting the engine temperature based on the temperature of the cooling water is mounted on a water jacket 11*c*.

A crank angle sensor 21 for detecting an engine revolution number and the crank angle sensor 21 is mounted on a distributer 20 of the engine. An igniter 22 is connected to the input side of the distributer 22 and a spark plug 23 is connected to the output side thereof.

The positive terminal of a battery $V_B$ is connected to a key switch SWk, one terminal of a power relay 24, and one terminal of a door relay 25. An ignition contact IG and a starter contact ST of the key switch SWk are connected to one terminal of an exciting coil 24*a* of the power relay 24.

One switch terminal of the door relay 25 is connected to the anode of a diode D1, the cathode of which is connected to an input terminal of the exciting coil 24*a* of the power relay 24.

The output terminal of the exciting coil 25*a* of the door relay 25 is grounded via a door switch 26. The door relay 25 and the door switch 26 constitute start ready detection means. A movable contact 26*a* of the door switch 26 is always forced by a spring 26*b* to turn on the door switch 26. The tip of the movable contact 26*a* faces a door (not shown) of an automobile. As the door is closed, the movable contact 26*a* is retracted against the force of the spring 26*b* to turn off the door switch 26.

A controller 27 controls the fuel injection quantity, ignition timings, opening of the ISCV 16. As shown in FIG. 2, the central processing unit (CPU) 28, backup RAM 29, work RAM 30 and program ROM 31 are interconnected via a bus 32. An A/D converter 33 and an interface 34 are connected to the CPU 28. An output of a constant voltage circuit 35 is supplied to the CPU 28 and the A/D converter 33.

The output terminal of the power relay 24 is connected to the input of the constant voltage circuit 35, and the input terminal of the power relay 24 switch is connected to the input of the backup RAM 29.

The air flow meter 14 and the water temperature sensor 19 are connected to the A/D converter 33 to supply an output signal Q representative of an air suction amount and an output signal $T_W$ representative of the engine temperature. The oxygen sensor 18 and the crank angle sensor 21 are connected to the interface 34 to supply an output signal $\lambda$ representative of the air-fuel feedback value, an output signal N representative of the engine revolution number, and an output signal $\theta$ representative of the crank angle.

The output terminal of the exciting coil 25*a* of the door relay 25 and the cathode of the diode D1 are connected to the interface 34 to supply output signals therefrom to the interface 34.

A driver circuit 36 receiving an output signal from the CPU 28 drives the injector 12, the ISCV 6, and the igniter 22.

The operation of the embodiment constructed as above will then be described.

Start Ready Operation

As a driver opens the door to ride on the automobile, the movable contact 26*a* of the door switch 26 projects by the force of the spring 26*b* so that the door switch 26 is caused to be turned on. Then, current flows from the battery $V_B$ into the exciting coil 25*a* of the door relay 25 to turn on the door relay 25.

Accordingly, current flows through the exciting coil 24*a* of the power relay 24 connected via the diode D1 to the door relay 25 so that the power relay 24 is caused to turn on.

When the power relay 24 is made turned on, a voltage is applied to the constant voltage circuit 35 of the controller 27 from which circuit a constant voltage is applied to the CPU 28, A/D converter 33, and the like. Therefore, the output signal $T_W$ of the water temperature sensor 19 for detecting the engine temperature based on the cooling water temperature at the water jacket 11*c* of the engine 11 is supplied to the A/D converter 33, and converter into a digital signal and subjected to calculation by the CPU 28 to store the engine temperature data into the backup RAM 29.

Next, as the driver sits down on a driver seat and closes the door, the movable contact 26*a* of the door switch 26 is retracted by the door against the force of the spring 26*b*, to thereby turn off the door switch 26.

Since it takes at least one second or more, during the period from when the door was opened and to when the door is closed, the controller 27 has completed necessary initialization during such a period, and has picked up a stable output signal from the water temperature sensor 19 and stored the engine temperature data in the backup RAM 29.

Although the power supply to the controller 27 is intercepted upon turning-off of the door switch 26, the engine temperature data at the start ready operation are not erased since the data are being stored in the backup RAM 29.

Engine Start Operation

Next, the key switch SWk is caused to connect the ignition contact IG to start the engine. Then, current flows through the exciting coil 24*a* of the power relay 24 to turn on the power relay. Therefore, a voltage is again applied to the controller 27, and a drive signal is applied to the driver circuit 36 from the CPU 28, the drive signal having been decided based on the engine temperature data stored in the backup RAM 29.

As the key switch SWk is caused to connect the starter contact ST, the starter motor (not shown) starts rotating of crankshaft (not shown) and starts a cranking operation. During the period from the start of the cranking to the complete combustion, the ignition timings, opening of the ISCV 16 and fuel injection quantity are stably controlled in accordance with the data stored in the backup RAM 29 without input data fluctuation due to the voltage drop during the cranking operation, to thus allow a good start performance.

Then, the driver circuit 36 outputs an ignition timing signal to the igniter 22, a valve opening signal to the ISCV 16, and a fuel injection pulse width signal to the injectors 12.

As the engine reaches complete combustion and the engine revolution number increases to a preset value, the CPU 28 judges a start completion of the engine in accordance with the engine revolution number signal N from the crank angle sensor 21 mounted on the distributer 20. Then, a normal running of the engine starts.

Signals (indicated by broken lines in FIG. 2) representative of the conduction state of the exciting coil 25*a* of the door relay 25 and the on/off state of the door relay 25 are being inputted to the interface 34 of the controller 27 to monitor the door relay 25.

Engine Stop Operation

When the key switch SWk is turned off to stop the engine, the power relay 24 is turned off and a power supply of the controller 27 is intercepted.

If the key switch SWk is turned off with the door being opened, the ignition and fuel supply system continues to operate because of the turning-on of the power relay 24. However, a key turning-off detection device (not shown) connectable to the key switch SWk detects the key turning-off state so that the ignition and fuel supply system stops its operation.

The present invention is not intended to be limited only to the above embodiment, but various modifications are possible. For instance, instead of the door switch 26, start ready detection means may use means such as an optical sensor for detecting that a driver is sitting upon the seat, means for detecting that the key switch is being inserted into the key cylinder, or other detection means.

As described so far, according to the present invention, the controller for controlling the engine in accordance with output signals from various sensors mounted on the engine is connected to start ready detection means for detecting the start ready condition and applying the voltage of the battery to the controller. The controller is provided with a backup memory in which data obtained by using the output signals from the sensors during the start ready operation are selectively stored, and an operation unit for use in starting the engine in accordance with the data stored in the backup memory. Therefore, the start cranking can be effected using the engine data at the time of the start ready operation so that a good engine start operation is possible without being affected by the voltage drop of the battery.

Further, the engine start control apparatus of this invention has a small number of components, is simple in construction and easy to handle, leaves an ample space of the engine room, and has versatile application to various automobiles since the mounting of the apparatus thereon is simple.

What is claimed is:

1. An engine start control apparatus comprising:

at least one sensor for detecting an engine condition;

a backup memory for storing data obtained by using the content of a detection by said sensor;

control means for controlling said engine in accordance with the stored data in said backup memory;

starting condition detector means for detecting a start ready state of said engine and outputting a start ready signal;

signal processing means for processing said content of a detection by said sensor and storing the processed result into said backup memory when said start ready signal is received;

means for detecting a start operation of said engine; and means for supplying a source voltage to said control means in response to an output signal from said start detection means.

2. An engine start control apparatus as set forth in claim 1, wherein said sensor comprises a sensor for detecting the temperature of the cooling water for said engine.

3. An engine start control apparatus as set forth in claim 1, wherein said starting condition detector means is a door switch.

4. An engine start control apparatus as set forth in claim 1, wherein said starting condition detector means is an ignition switch.

5. An engine start control apparatus as set forth in claim 1, wherein said control means includes a constant voltage circuit.

6. An engine start control apparatus as set forth in claim 1, wherein said control means starts its initialization in response to said start ready signal.

* * * * *